US007364136B2

(12) United States Patent
Hossler

(10) Patent No.: US 7,364,136 B2
(45) Date of Patent: Apr. 29, 2008

(54) HOIST ASSEMBLY

(75) Inventor: Brad E. Hossler, Tiffin, OH (US)

(73) Assignee: Tiffin Scenic Studios, Inc., Tiffin, OH (US)

( * ) Notice: Subject to any disclaimer, the term of this patent is extended or adjusted under 35 U.S.C. 154(b) by 0 days.

(21) Appl. No.: 11/457,693

(22) Filed: Jul. 14, 2006

(65) Prior Publication Data

US 2007/0181862 A1 Aug. 9, 2007

Related U.S. Application Data

(60) Provisional application No. 60/669,767, filed on Jul. 15, 2005.

(51) Int. Cl.
*B66D 1/26* (2006.01)

(52) U.S. Cl. ..... 254/278; 254/393

(58) Field of Classification Search ..... 254/278, 254/371, 393

See application file for complete search history.

(56) References Cited

U.S. PATENT DOCUMENTS 4,193,311 A * 3/1980 Rinio et al. ..... 474/9
4,345,741 A * 8/1982 Rinio et al. ..... 254/287
6,520,485 B1 2/2003 Soot
6,601,828 B2 * 8/2003 Strbuncelj et al. ..... 254/266
6,634,622 B1 10/2003 Hoffend, Jr.
6,691,986 B2 2/2004 Hoffend, Jr.
2006/0284151 A1 12/2006 Hossler

FOREIGN PATENT DOCUMENTS

EP 1038561 A2 9/2000
GB 2348151 A 9/2000

OTHER PUBLICATIONS

Web page—www.stagetech.com/products/bigtow.htm, Apr. 21, 2005.
Brochure—BigTow 2 Winches.

* cited by examiner

*Primary Examiner*—Emmanuel M Marcelo
(74) *Attorney, Agent, or Firm*—Barnes & Thornburg LLP; Alice O. Martin

(57) ABSTRACT

A hoist assembly for raising and lowering a load uses a plurality of flat tensile members and spool drums. A modular hoist system can be adapted to various configurations by mounting a plurality of hoist assemblies in combination.

14 Claims, 15 Drawing Sheets

HOIST ASSEMBLY

CROSS REFERENCE TO RELATED APPLICATIONS

This application claims priority from U.S. Provisional Application Ser. No. 60/699,767 filed Jul. 15, 2005.

BACKGROUND

Hoists that lift loads in a vertical direction are used in many industries for a variety of applications. Single lift hoists are commonly used for heavy equipment and parts lifts for construction, architectural and industrial uses such as manufacturing plants, steel mills and transport loading facilities. These applications generally do not involve raising a load directly over people for safety reasons.

For theatrical settings, athletic and entertainment arenas, overhead lifting with higher safety standards are routinely required because hoists are lifting loads directly over human beings. For applications where loads are lifted above people, a plurality of lifts are generally required to meet applicable safety regulations.

Live performances in a theater typically employ a number of curtains and backdrops to convey to the audience different settings, environments, moods, and the like. These curtains and backdrops must be changed throughout the course of a performance within a fairly short time frame without interrupting the performance. Typically this is done by raising a particular backdrop above the stage and out of sight of the audience when it is not being used. When a particular backdrop is needed, it is lowered into place on the stage.

Theatrical backdrops and curtains are typically suspended from battens, which are pipes or trusses that span the width of the stage. Battens can be 20 feet or more in length, depending on the size of the stage. As should be apparent, the weight of the battens and the items suspended from them can have substantial weight. As the weight of the load increases so does the power required to raise the load. Counterweights are employed to balance the load of the batten and its associated load. Battens and their associated counterweights are manually lifted and lowered. In these types of systems, a rope is tied to a counterweight and the batten is manually raised or lowered, then tied off to a pin rail mounted to a wall adjacent the stage area. However, if the load is not closely balanced, excessive power may be required to move the load. Alternatively, the system may get out of control, dropping the load or the counter-weight, causing injury or death to people nearby and/or collateral damage.

Typical motorized hoists and winches have a grooved drum for winding and unwinding the cable attached to the battens. One or more grooves are typically disposed in a helical arrangement about the drum. A cable is fixed to the drum and disposed in the groove when it is wound about the drum. As the cable is unwound, the cable leaves the drum and passes over one or more sheaves to change the orientation of the cable from the drum to the batten. The angle at which the cable pays off the drum is the fleet angle, defined as the angle between the centerline of the groove on the drum and the cable coming off the drum. The fleet angle should be kept to a minimum because increasing the fleet angle results in increased wear on the cable and drum. Therefore it is desirable to minimize the fleet angle to prolong cable and drum life.

SUMMARY

A hoist assembly for raising and lowering a load uses a plurality of flat tensile members and spool drums. A modular hoist can be adapted to various configurations by mounting a plurality of hoist assemblies in combination. Each hoist assembly may accommodate from 1 to 15 aligned flat tensile members by adding backing plates to spool drums. Furthermore, the hoist of the present disclosure provides for a compact arrangement allowing for installation in places where space is limited. Additionally, by using a flat tensile member wound on top of itself, the fleet angle is maintained nearly constant.

The hoist for raising and lowering a load has a frame with a gear motor mounted thereon, a drive shaft coupled to the gear motor, a drum attached to the drive shaft, with at least one tensile member wound about the spool drum and a head block for receiving the tensile member as it leaves the spool drum maintained in position to be substantially aligned with the tensile member. There are two possible take-off routes, one to a take off sheave and one to a loft block (idler). Theatrical hoists for lifting loads over people generally have overhead factors in the range of 8:1 to 5:1. For non-overhead hoists, factors may be lower, e.g. 5:1 to 3:1. Tensile members may include flat cables, webbing, rope, and bands.

Additional features and embodiments will become apparent to those skilled in the art upon consideration of the following detailed description of drawings.

BRIEF DESCRIPTION OF THE DRAWINGS

The present disclosure will be described hereafter with reference to the attached drawings which are given as a non-limiting example only, in which.

DETAILED DESCRIPTION

Figure 1:
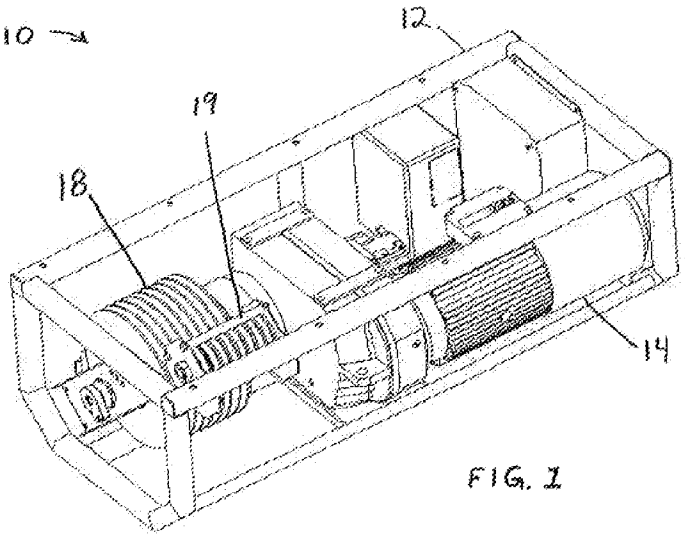
FIG. 1 is a perspective view of the hoist of the present disclosure.
Figure 4:
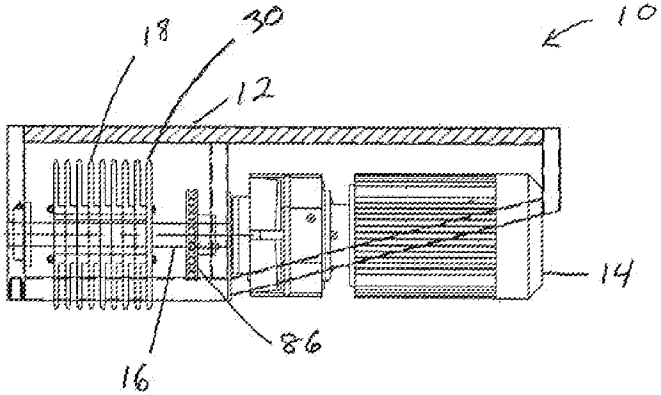
FIG. 4 is a side elevation of the hoist of FIG. 2.

A hoist assembly for raising and lowering loads such as stage scenery, lighting, drapery, equipment, machinery, has a modular design allowing additional hoist assemblies to be added depending on the load size, weight, configuration, or other properties. A plurality of flat tensile members between the load and spool drum, allow efficient hoisting while maintaining a nearly constant fleet angle.

FIGS. 1 through 4 show a modular hoist assembly 10 of the present disclosure.

The components of the hoist assembly 10 are mounted onto a frame 12. The frame 12 is composed of a number of support members forming a truss structure for mounting the components of the hoist assembly 10. The frame may be constructed of tube steel, angle iron, or other suitable material. In the embodiment shown, the truss is generally of a box-type truss although it is within the scope of the present disclosure for the frame to be of any suitable configuration.

A gear motor 14, being a combination of an electric motor and a gear reducer as is commonly known in the art, is located at one end of the support frame 12. The gear motor 14 is coupled to a drive shaft 16 which drives one or more spool drums 18. The spool drum 18 receives a flat tensile member 20 that is attached to the load for raising and lowering.

Figure 11:
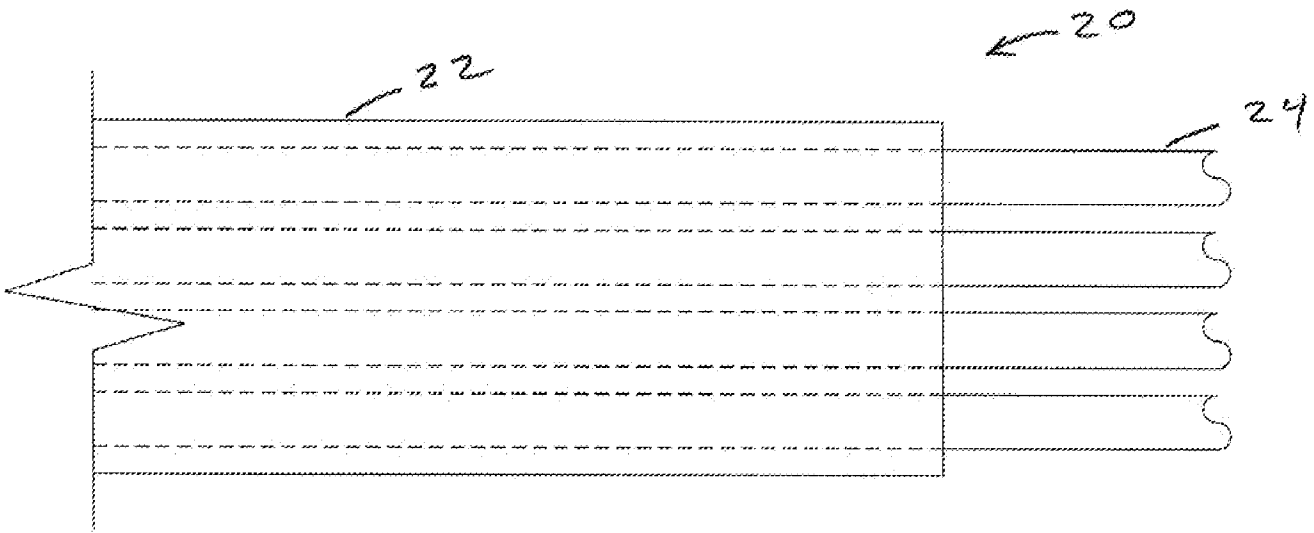
FIG. 11 is a plan view of the flat tensile member of FIG. 10.
Figure 10:
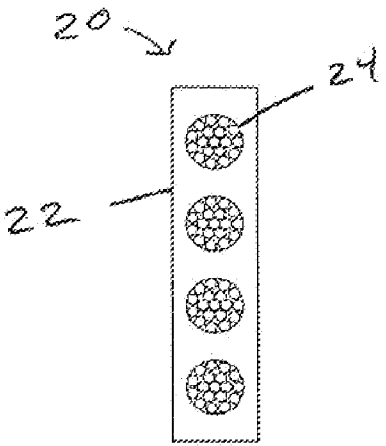
FIG. 10 is a cross-section of the flat tensile member of the hoist of FIG. 1.

As shown in FIGS. 10 and 11, one embodiment of the flat tensile member 20, is a flat cable design. The flat cable has a plurality of round steel cables or wire ropes 24 linearly oriented and encapsulated within a flexible and resilient coating 22 such as rubber, polyethylene or other suitable polymeric material. Other suitable embodiments o the flat tensile member include flat polymeric fiber webbing or rope. For example, polymeric fiber sold under the brand names SPECTRA® and VECTRAN® are commonly used for flat strap webbing and rope. It should be apparent to one skilled in the art that such polymeric fiber webbing and ropes may be formed from a number of polymers including polyethylene, polypropylene, polyolefin and polyamides. Yet another suitable embodiment includes flat steel strapping, which may be coated with rubber, polyethylene, or other resilient flexible material.

Figure 6:
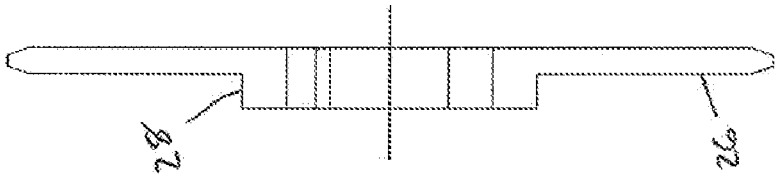
FIG. 6 is an edge view of one section of the spool drum of FIG. 5.
Figure 5:
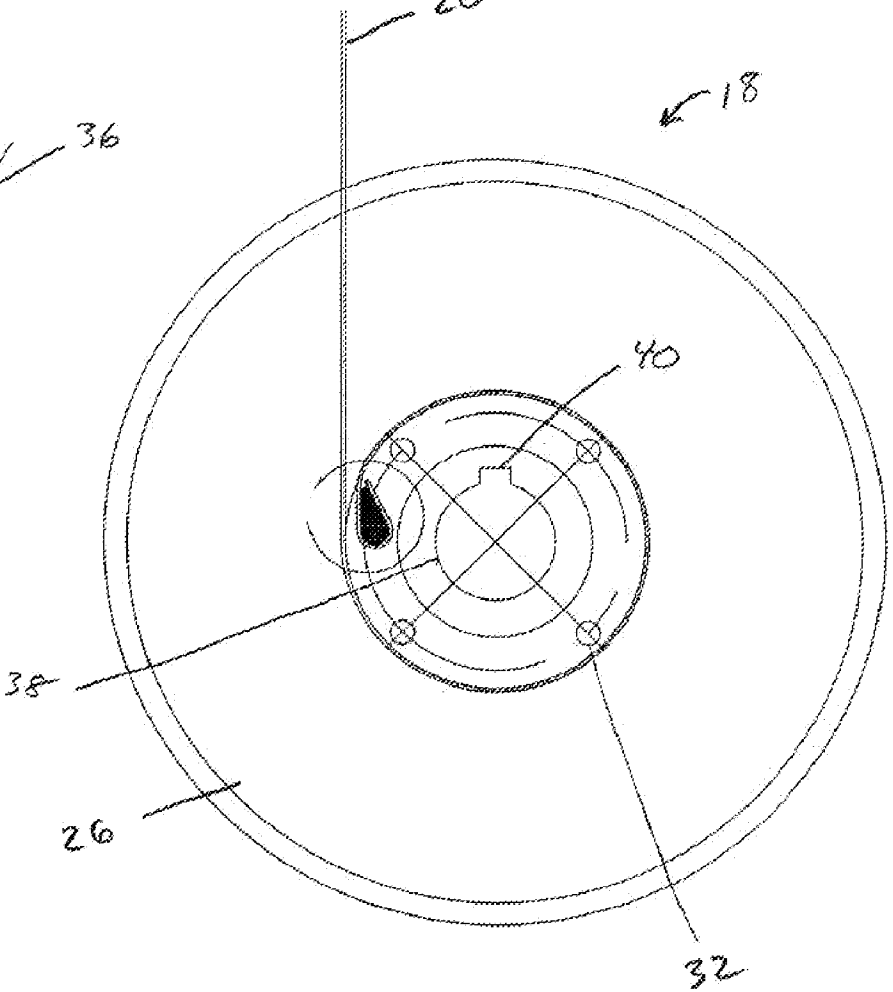
FIG. 5 is a view of a spool drum for the hoist of FIG. 2.
Figure 7:
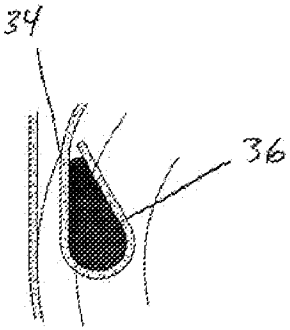
FIG. 7 is a detail of the tensile member connection to the spool drum of FIG. 5.

Referring to FIGS. 5 to 7, the spool drum 18 has a disk portion 26 and a hub portion 28. For an embodiment having a single spool drum, an end plate 30 is attached to the spool drum 18 by bolts cooperating with bolt holes 32 in the hub portion 28. When multiple spool drums are used, as generally shown in FIG. 1, only one end plate 30 is required because the spool drums are stacked together such that the rear side of the disk portion of one spool drum acts as an end plate for a second spool drum and so forth.

A flat tensile member 20 is wrapped around the hub portion 28 of the spool drum 18 and fed through a slot 33 lending to an aperture 34 in the hub portion 28. The flat tensile member 20 is wrapped around a wedge dead-off 36 that is inserted into the aperture 34 within the hub portion 28 to secure the flat tensile member 20. The flat tensile member 20 is wrapped around the wedge dead-off 36 such that when a load is applied to the flat tensile member 20, the tension in the tensile member 20 pulls the wedge dead-off 36 into the aperture 34, compressing the tensile member 20 between the wedge 36 and the aperture 34 in the hub portion 28, thus securing the tensile member.

Figure 8:
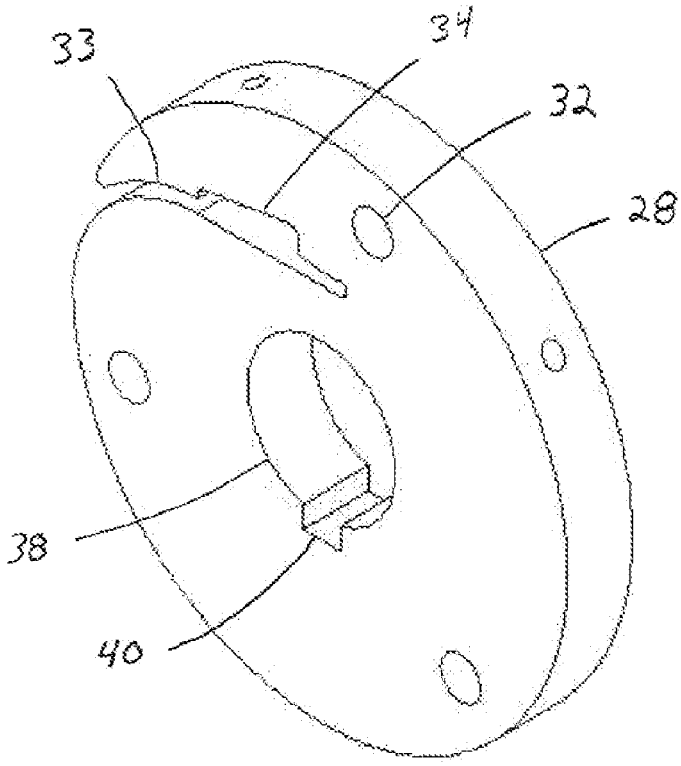
FIG. 8 is a detail of a hub portion of a spool drum of FIG. 5.

FIG. 8 shows a detailed view of the arrangement of the slot 33 leading to aperture 34 within the hub portion 28. Aperture 34 is configured in a wedge shape to correspond to the wedge dead-off 36. By wrapping the tensile member 20 first along the outer edge of the wedge dead-off, than around to the tip, when a load is applied to the tensile member 20, the dead-off 36 is pulled towards the narrow portion of aperture 34. Thus, the tension created by the load acts to secure the tensile member 20.

Figure 9A:
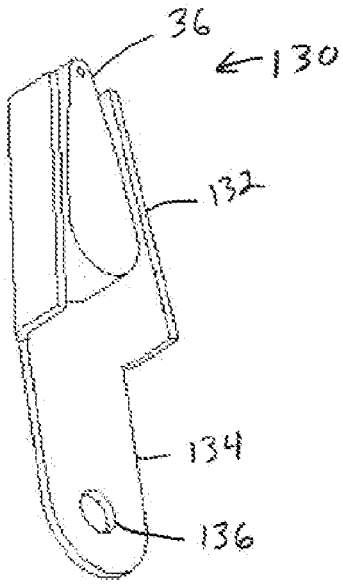
FIGS. 9A and 9B are detailed views of load connectors.
Figure 9B:
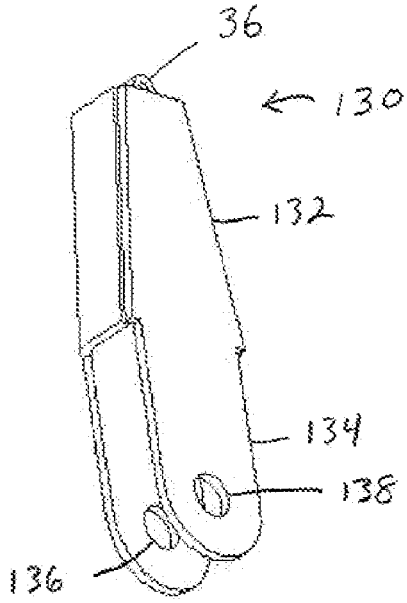

FIGS. 9A and 9B show the corresponding connectors 130 attached to the load such as a batten and truss, Connectors 130 have a wedge-shaped receptacle portion 132 configured to receive a wedge dead-off 36 as previously described. Adjacent to the receptacle portion 132 is a clevis portion 134 having apertures 136, 138. A tensile member 20 is secured within the receptacle portion 132 by wrapping around the dead-off 36 as previously described.

Each spool drum 18 has a hole 38 with a keyway 40 at the center of the boss for attachment to the drive shaft. Similarly, the end plate 30 has a keyed hole at its center. The end plate 30 is positioned on the drive shaft along with at least one spool drum 18. When the desired number of spool drums have been positioned on the drive shaft, the spool drums are fastened together. Bolt holes are provided in each spool drum and the end plate for receiving bolts or threaded rods for fastening together the spool drums.

One tensile member 20 is secured to and wrapped about the hub 28 of each spool drum 18. The tensile member 18, being flat, is wrapped in layered fashion about itself, rather than being wound helically on a drum. Since the tensile member 20 is not wound helically, it pays out from the spool drum 18 at a single point, therefore providing a substantially constant fleet angle. As the tensile member unwinds from the spool drum 18, the tensile member 20 passes through head blocks 19 to loft blocks 42 which change the direction of the tensile member towards the load 114 being raised or lowered. The head blocks 19 are typically attached to the frame 12 or in close proximity to the hoist assembly 10. The loft blocks 42 are typically attached to the building structure but may be attached to the hoist frame 12 as well, as in the case of a short line loft block 80 discussed below. Additionally, the loft blocks may accommodate a single tensile member, a single line loft block, or may accommodate multiple cables, a multi-line loft block.

Figure 18:
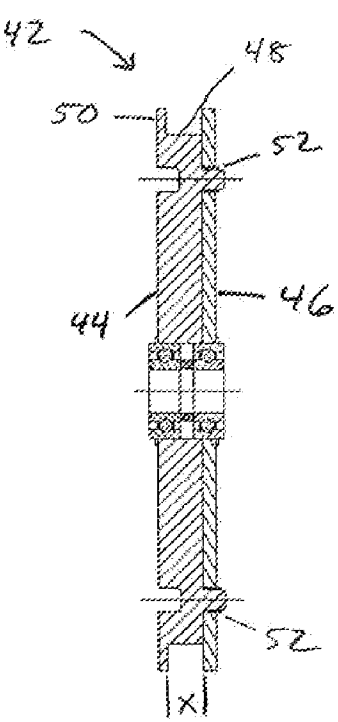
FIG. 18 is a section view taken at line A-A of the single line loft of FIG. 17.
Figure 17:
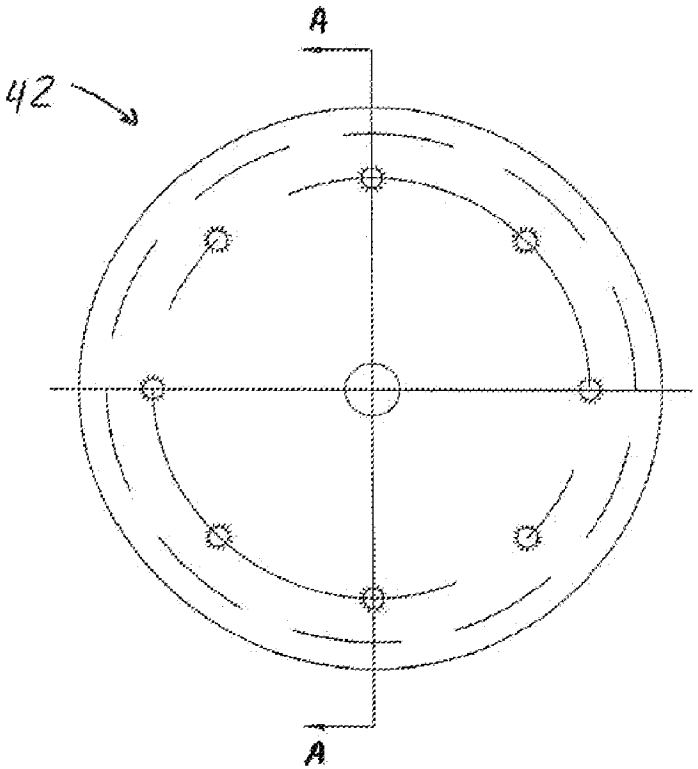
FIG. 17 is a side view of a single line loft block.

The head block 19 and loft block 42 have similar construction and are described herein with reference to a loft block. A single line loft block, as shown in FIGS. 17 to 19, is a circular sheave having a body 44 and an end plate 46.

Figure 15:
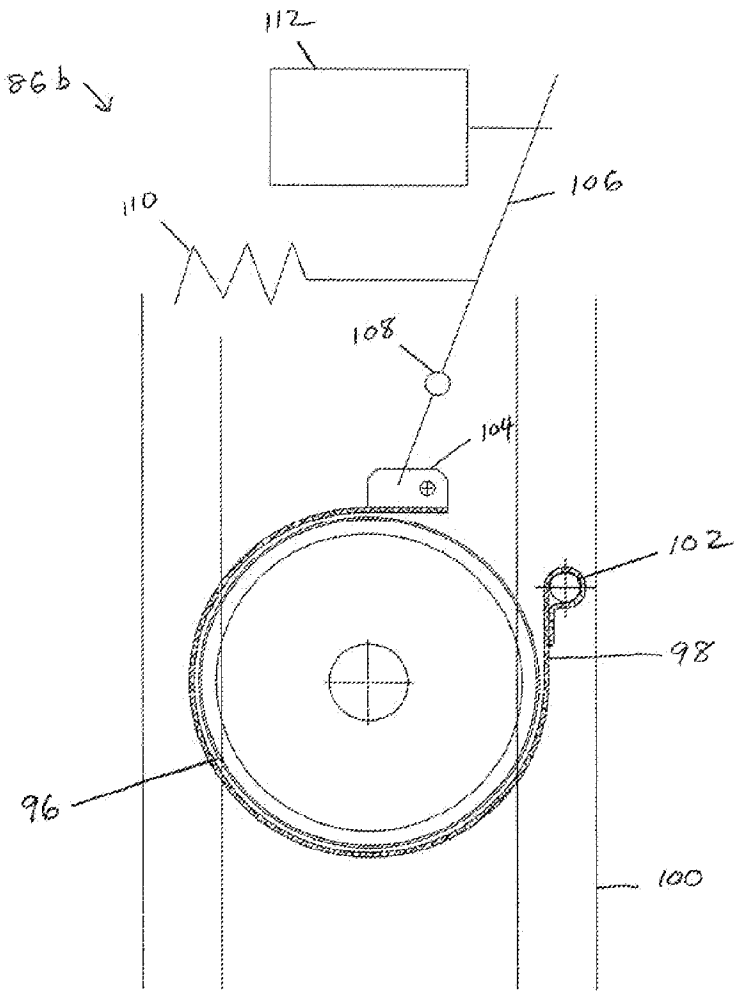
FIG. 15 is an alternate embodiment of a brake for the hoist of FIG. 1.

The body 44 is generally circular with a hub portion 48 and a flange portion 50. The end plate 46 is fastened to the body 44 so that the flange of the body is spaced apart from the end plate, forming a hub to accept the tensile member 20. As shown in FIG. 15, the single line loft block is configured to accept a flat tensile member 20 with the distance "X" shown in FIG. 18 being slightly larger than the width of the flat tensile member 20, allowing the tensile member to freely wind and unwind about the spool drum. The body 44 and end plate 46 are joined by helix fasteners 52 inserted through apertures 54 in the end plate. An aperture in the center of each of the body and end plate are adapted to receive bearing assemblies 56, 58 with a spacer 60 therebetween. The loft block 42 is on an axle (not shown) within a housing 62 having a pair of substantially parallel side plates 64, 66 spaced apart on either side of the sheave and fastened together. The loft block housing 62 is attached to and supported by the building structure.

Figure 19:
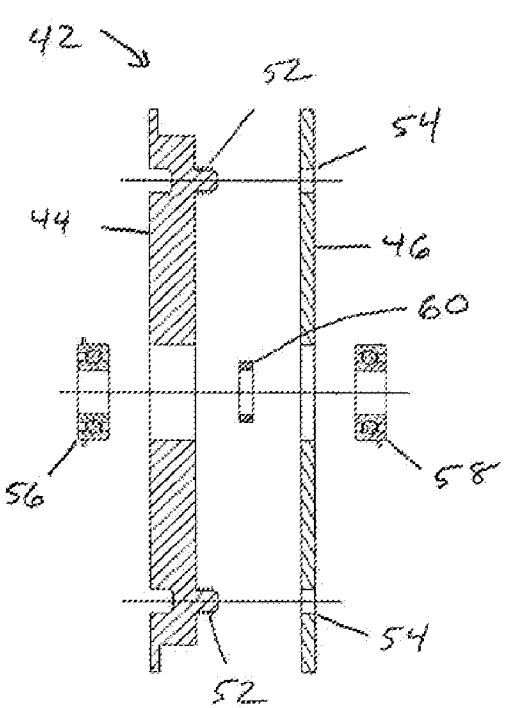
FIG. 19 is an exploded section view taken at line A-A of the single line loft of FIG. 17.
Figures 20, 21:
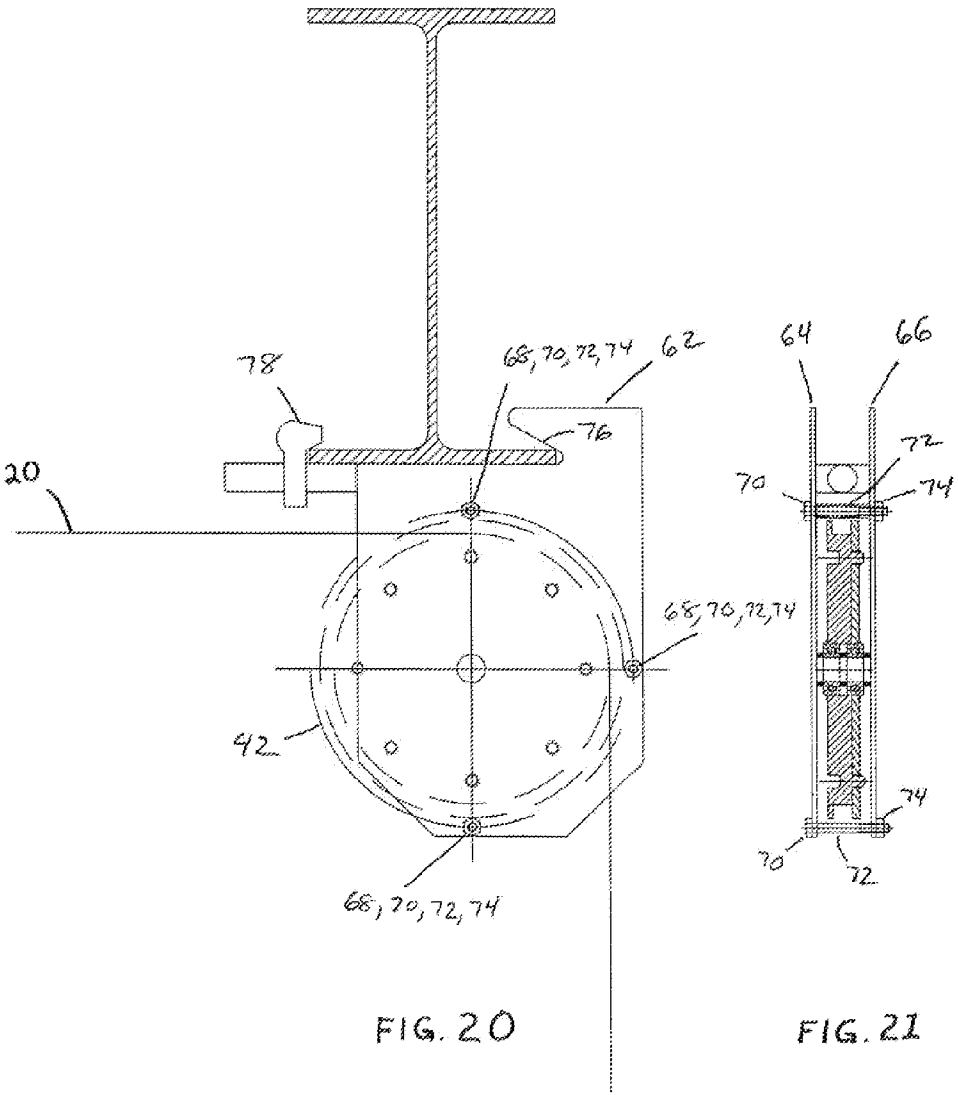
FIG. 20 is a side view of a single line loft block housing assembly.
FIG. 21 is an end view of the single line loft block housing assembly of FIG. 20.
Figure 24:
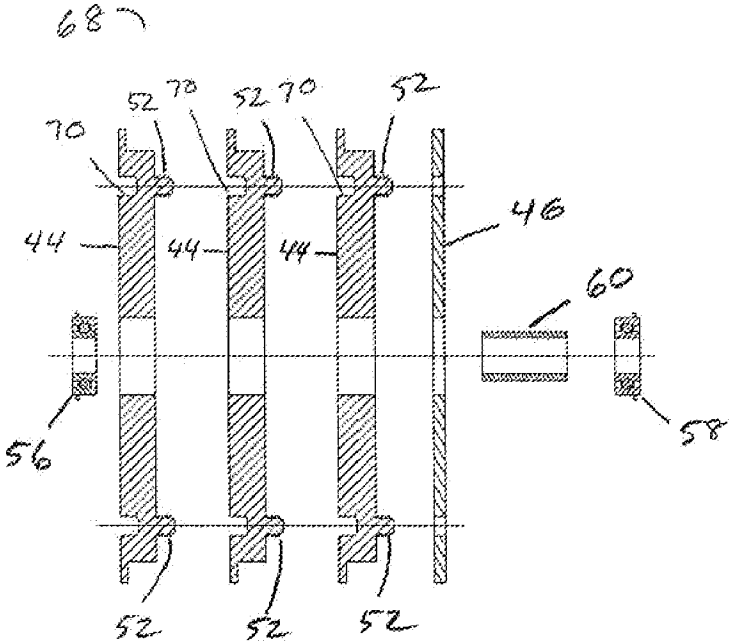
FIG. 24 is an exploded section view taken at line B-B- of the multi-line loft of FIG. 22.
Figure 23:
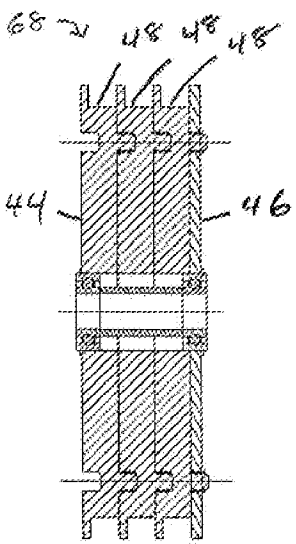
FIG. 23 is a section view taken at line B-B- of the multi-line loft of FIG. 22.
Figure 22:
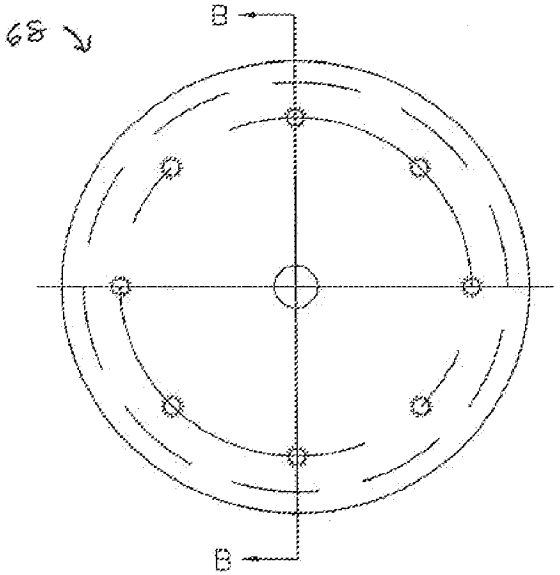
FIG. 22 is a side view of a multi-line loft block.

A multi-line loft block 68 as shown in FIGS. 19 to 21 are similar to the single line loft block, however, additional loft block bodies 44 are assembled in a stacked arrangement. Recesses 70 are provided on the back of each loft block body 44 to accept helix 52 from the next loft block body. Like the single line loft block 42, bearing assemblies 56, 58 fasteners separated by a spacer 60 are fitted within the center apertures of the loft block bodies and the loft block end plate.

Loft blocks are positioned at various points above the load to redirect the cable or cables towards the load. Supporting the loft blocks are loft block housings 62 as shown in FIGS. 20 and 21. The loft block housing 62 comprises a first and second spaced apart substantially parallel plates 64, 66. The plates 64, 66 contain a number of aligned holes 68. Bolts 70 are positioned through the holes 68, with a spacer bushing 72 positioned about the bolts 70 between the plates 64, 66 to maintain spacing. The bolts 70 are each threadedly engaged with a nut 74 to secure the plates together forming the housing 62.

In FIG. 20, the loft block housing contains a notch 76 for positioning about one side of a flange of an I-beam of the building structure. A clamp 78 is positioned engaging the opposite side of the flange thus securing the loft block to the building. It should be understood that other suitable means of securing the loft block to the building structure are equally acceptable and are within the scope of the present disclosure. Such means may include bolting, clamping, welding, or other means known in the art.

Figure 2:
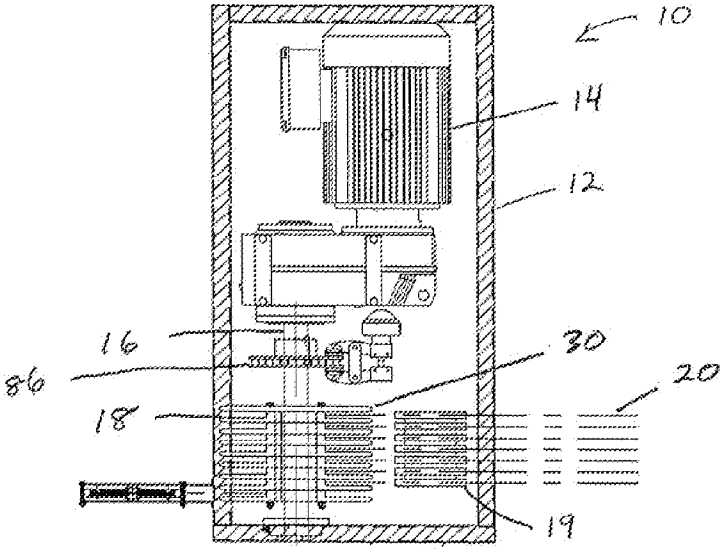
FIG. 2 is a plan view of the hoist of the present disclosure.
Figure 3:
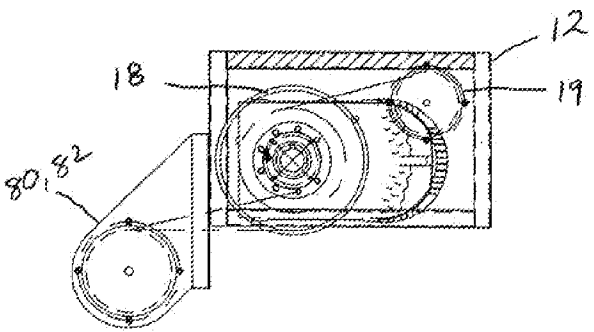
FIG. 3 is an end view of the hoist of FIG. 2.

Referring to FIG. 2, a short line loft block 80 may be used to redirect a tensile member where the load attachment point is substantially directly below the hoist assemble. The short line loft block housing 82 is attached to the hoist frame 12 and may be of either the single line or multi-line type.

Figure 12:
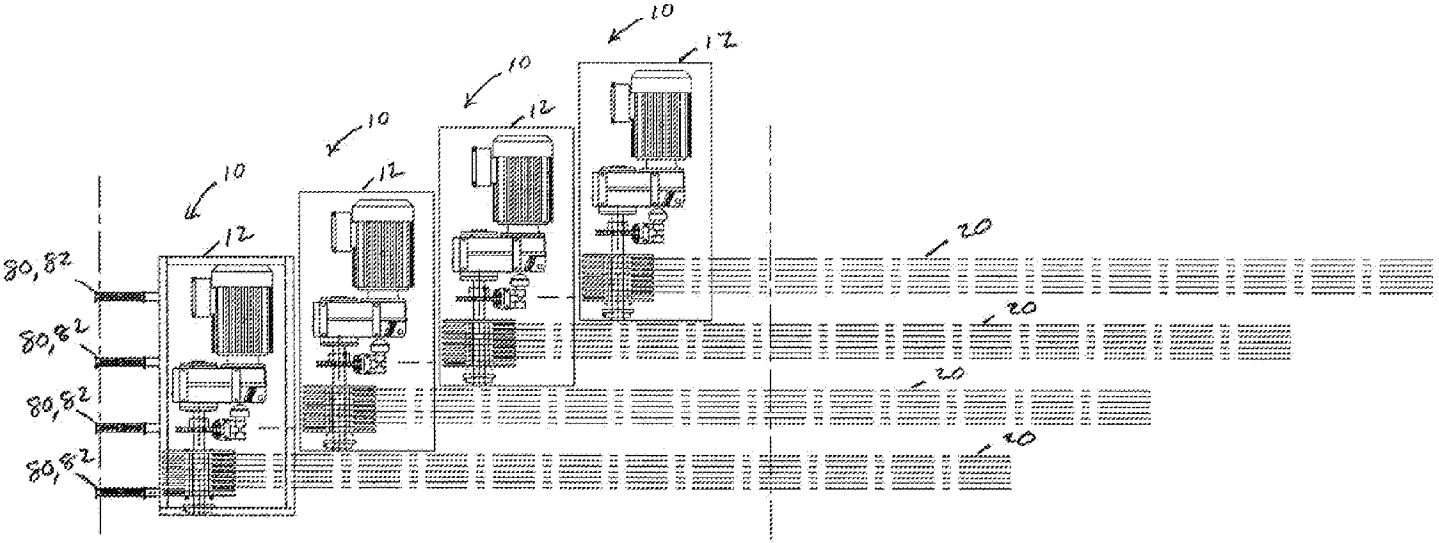
FIG. 12 is a plan view showing multiple hoist assemblies in a modular configuration.
Figure 13:
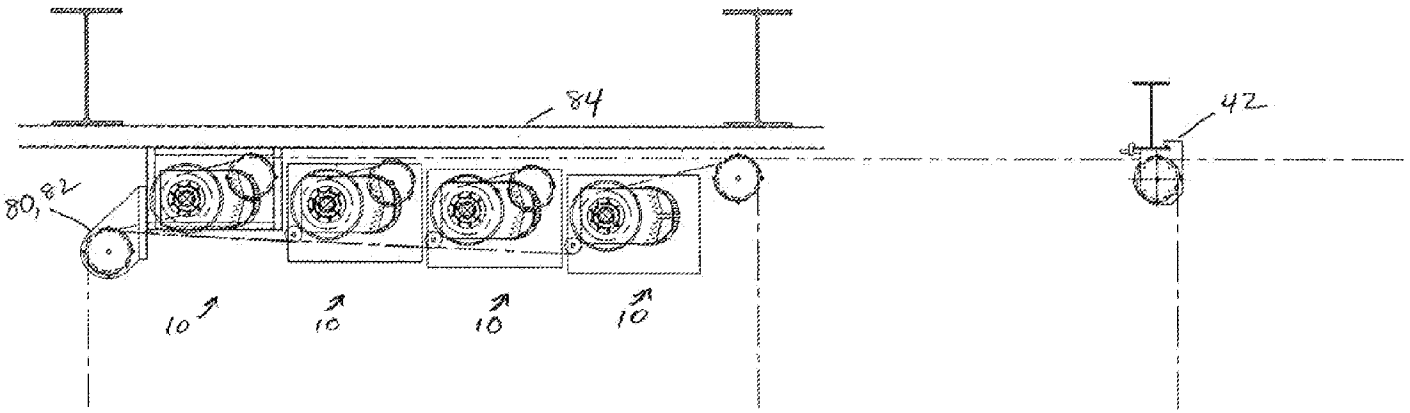
FIG. 13 is an elevation view of the modular hoist assemblies shown in FIG. 12.

Referring to FIGS. 12 and 13, the hoist 10 of the present disclosure may be configured as a modular assembly with multiple units. For example, the embodiment of FIGS. 12 and 13 shows four hoist assemblies configured together. Each assembly 10 is mounted on a super-frame assembly 84 horizontally and vertically offset to avoid interference between sets of tensile members. Although the particular embodiment of FIGS. 12 and 13 shows four hoist assemblies 10 in a modular configuration, it should be clear to one skilled in the art that a greater or lesser number of units may be used depending on the particular application.

Also referring to FIG. 10, the hoist assembly is mounted to the building structure. In this particular embodiment a super-frame assembly 84 is attached to the building structural steel and the hoist frames are attached to the super-frame 84. The super-frame 84 may be attached to the structural steel my any of the means known in the art such as welding, bolting, clamping, and the like.

Figure 14:
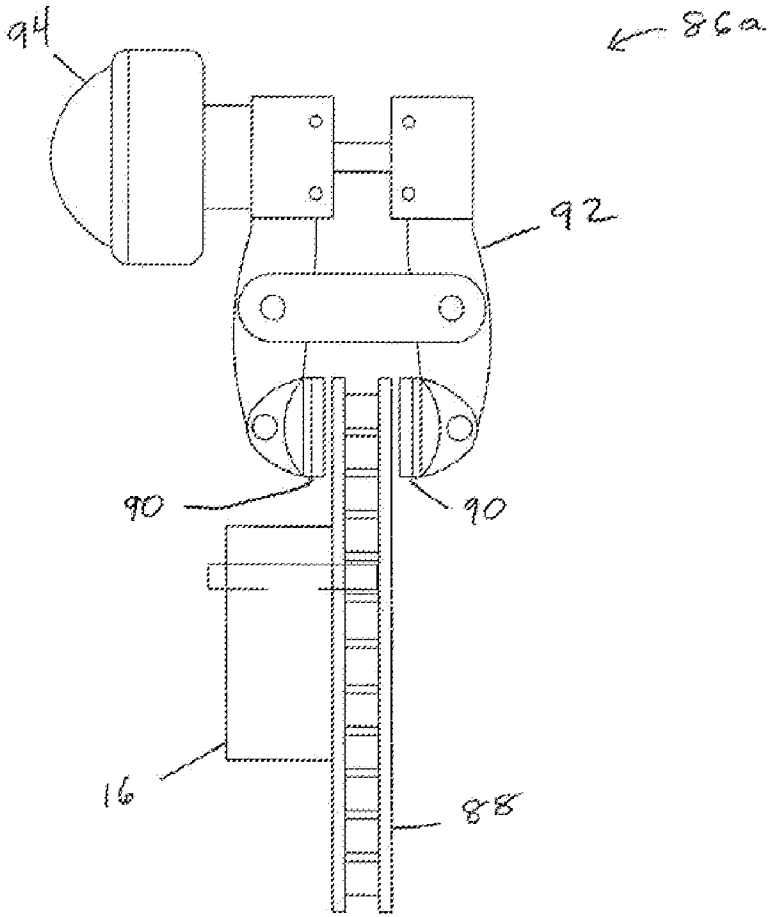
FIG. 14 is an embodiment of a brake for the hoist of FIG. 1.

The hoist of the present disclosure may be equipped with a brake 86 to prevent the load from inadvertently falling. The brake 86 is thus a safety device for the protection of individuals located below the load 114. One embodiment of a brake acceptable for use with the hoist of the present disclosure is a disk brake 86*a* shown in FIG. 14 as is generally known in the art. The brake disk 88 is coupled to the drive shaft 16 of the hoist. Brake shoes 90 are positioned on a caliper 92 adjacent to the outer surfaces of the brake disk 88 with sufficient clearance to allow the disk to freely rotate with the shaft during normal operation. The caliper 92 is arranged to spring-apply the brake shoes 90 and electrically release. In this way, loss of control power locks the brake preventing the load from falling. In normal operation an electrical signal releases the caliper 92 allowing the disk 88 and shaft 16 to rotate freely. A speed sensor (not shown) attached to the drive shaft 16 provides a signal to the control unit. Upon sensing an overspeed, an unacceptable acceleration of the shaft, the controller sends a signal that removes power from an actuator 94 on the caliper forcing the shoes 90 against the outside surfaces of the disk 88 stopping rotation of the shaft.

Figure 16:
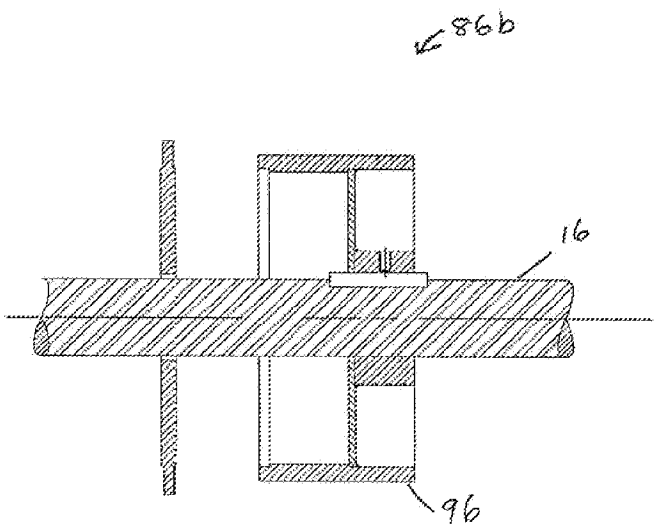
FIG. 16 is a section view of the brake embodiment of FIG. 15.

Another acceptable embodiment of a brake for the present disclosure includes a band brake 86*b* as is known in the art. As shown in FIGS. 15 and 16, a typical band brake comprises a drum 96 fixed to the drive shaft 16 of the hoist. A band 98 is positioned about a portion of the circumference of the drum 96 with sufficient clearance to allow the drum to rotate freely. At one end the band is attached to the brake frame 100 by bolt 102 or other suitable means known in the art. The band is positioned about the drum and its second 104 end is connected to a lever 106. The lever 106 is pivotally connected to the brake frame 100 by a pivot pin 108. A tension spring 110 exhibits a force against the lever 106 engaging the band 98 with the drum 96, and thus preventing rotation of the drum 96 and drive shaft 16. An actuator 112 is arranged to overcome the spring force and release the band 96 from the drum 96 upon receipt of an electrical signal under normal operation. Like the disk brake 86*a*, a speed sensor attached to the drive shaft 16 provides a signal to the control unit. Upon sensing an overspeed, an unacceptable acceleration of the shaft, the controller sends a signal that removes power from the actuator on the lever forcing the band against the outside circumference of the drum stopping rotation of the shaft.

Figure 25:
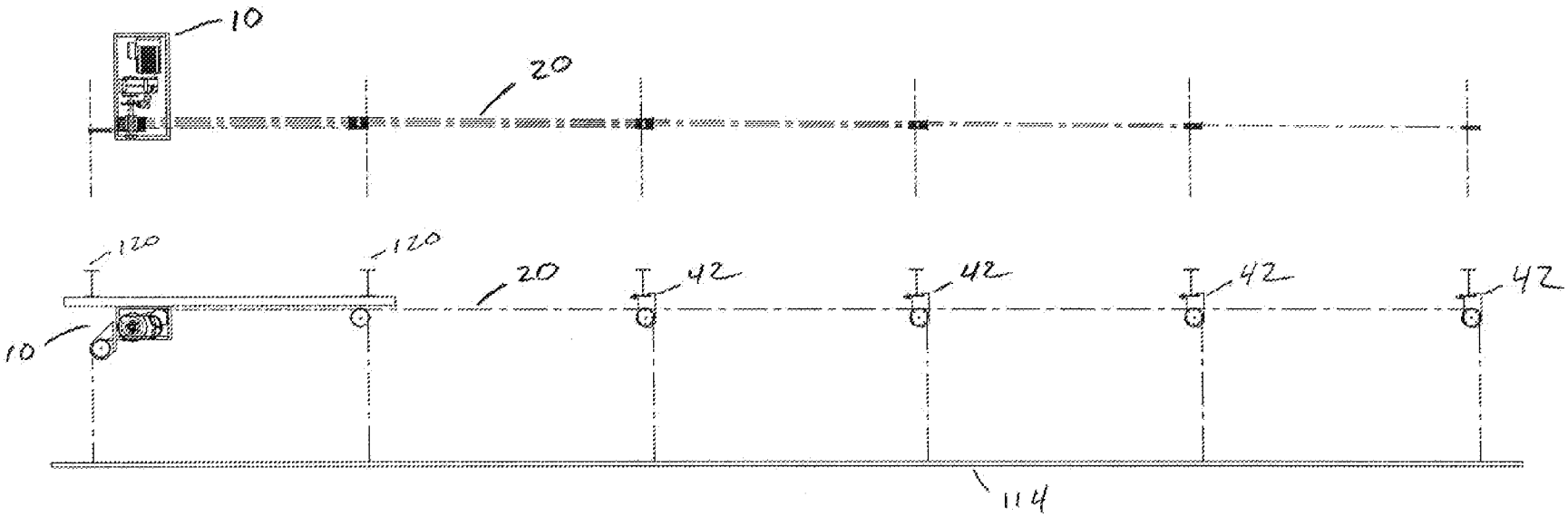
FIG. 25 is an elevation view showing the hoist assembly of the present disclosure mounted to building structural steel in an under-slung manner.
Figure 26:
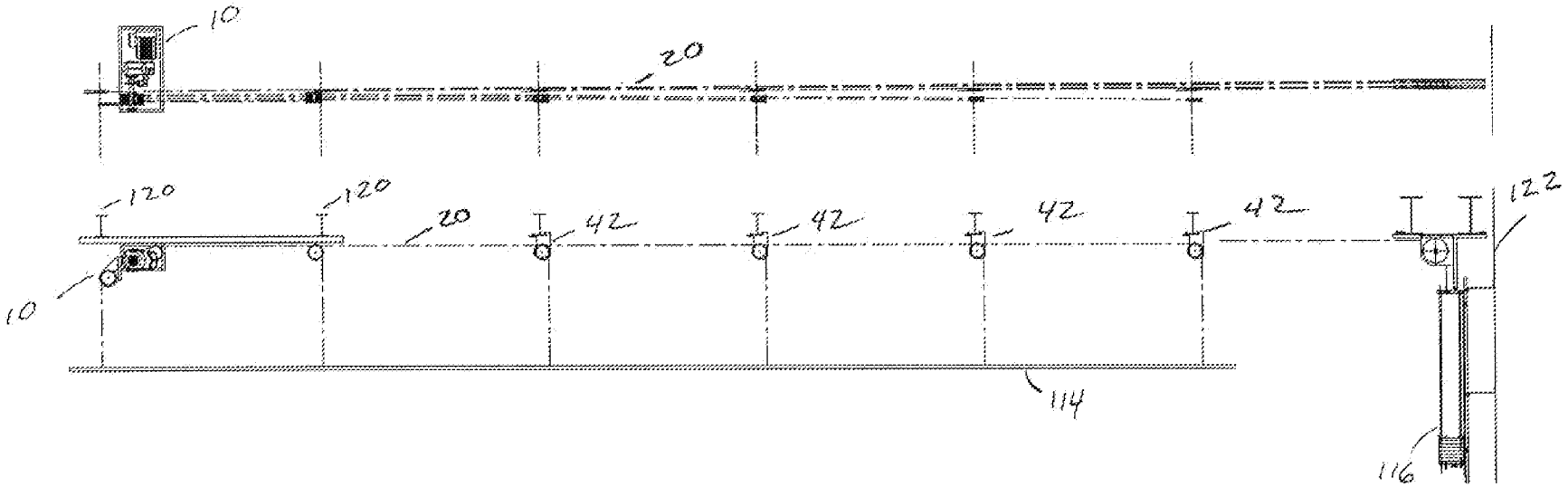
FIG. 26 is an elevation view showing the hoist assembly of the present disclosure under-slung mounted with a counter weight mounted on a building wall.
Figure 27:
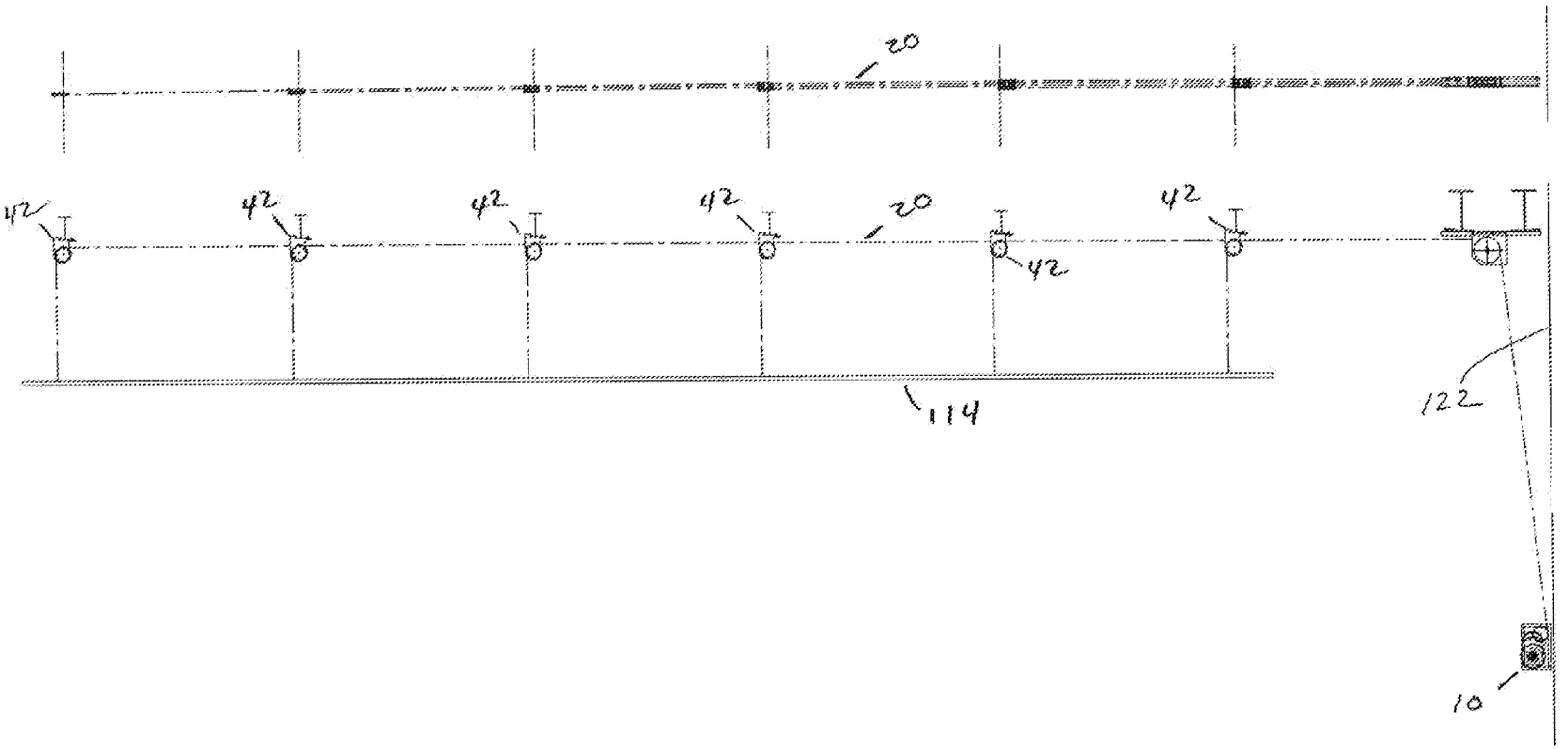
FIG. 27 is an elevation view showing the hoist of the present disclosure mounted on a building wall.
Figure 28:
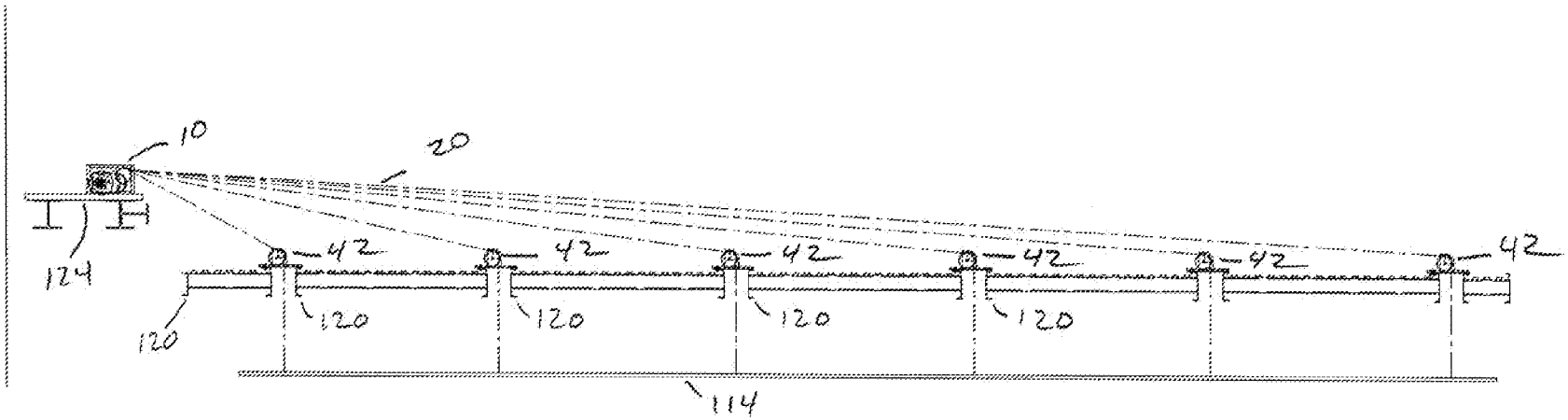
FIG. 28 is an elevation view showing a platform mounted hoist of the present disclosure.
Figure 29:
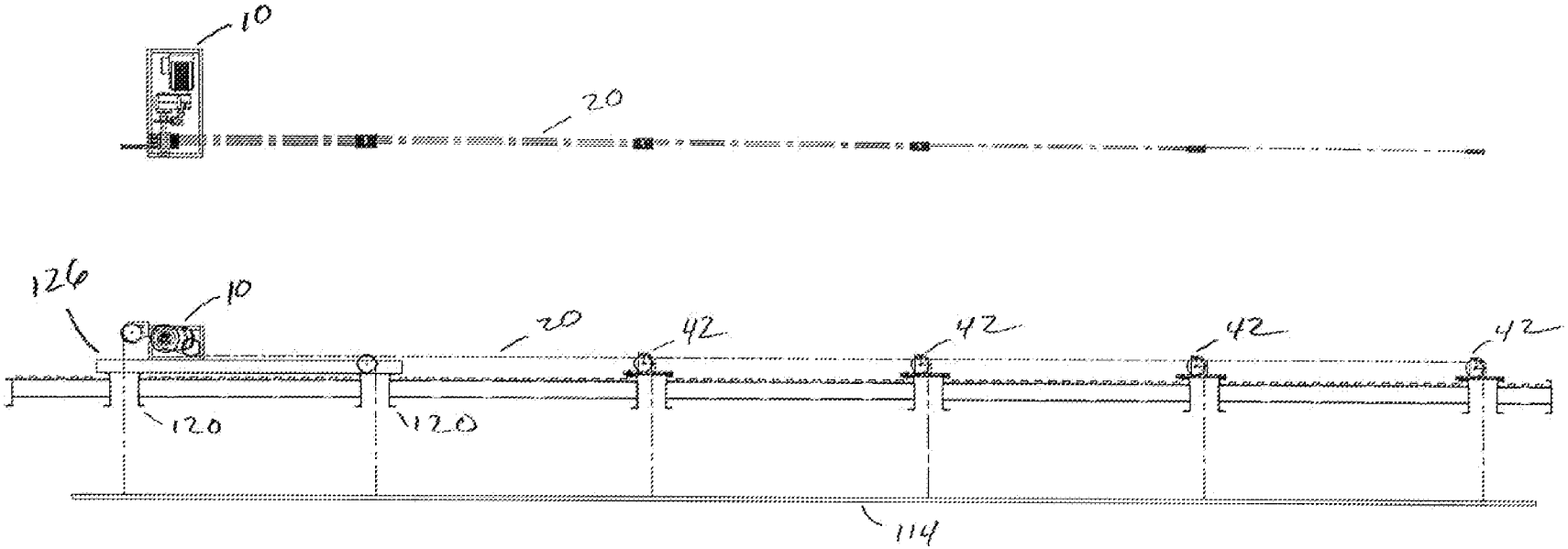
FIG. 29 is another embodiment of a platform mounted hoist of the present disclosure, wherein the hoist is mounted on the building structural steel.

It is contemplated that the hoist of the present disclosure may be mounted in a number of configurations as shown in FIGS. 25 through 29. FIGS. 25 and 26 shows the hoist assembly 10 mounted in an under-slung fashion to the building structural steel 120. FIG. 26 likewise shows the hoist of the present disclosure under-slung mounted with a counterweight mounted to a building wall 122. FIG. 27 shows a hoisting assembly mounted to a building wall. An alternative embodiment shown in FIG. 28 has the hoist assembly 10 mounted on a platform 124 that is spaced apart from the building structural steel 120. Finally, in yet another embodiment shown in FIG. 29, the hoist assembly may be mounted on a platform 126 that is supported by building structural steel 120. This ability to adapt to numerous configurations allows for adaptation to a variety of locations with different spatial constraints.

I claim:

1. A hoist assembly for raising and lowering a load comprising:

a frame comprising a plurality of support members;

a gear motor mounted to said frame;

a drive shaft coupled to said gear motor;

at least one spool drum mounted on said drive shaft, said spool drum having a disk portion and a hub portion, said hub portion having an aperture configured such that said hub portion is disposed about said drive shaft; and an end plate fixed to said hub portion opposite to and spaced from said disk portion, wherein said spool drum is configured to receive a flat tensile member disposed between said disk portion and said end plate, said disk portion and said end plate spaced apart so as to freely allow said tensile member to wind and unwind on itself about said hub portion.

2. The hoist assembly of claim 1 further comprising:

a cuneal aperture disposed within said hub portion configured to receive a dead-off; and a slot within said hub portion extending from a tip of said cuneal aperture to the outer edge of said hub portion, wherein said cuneal aperture and said slot cooperate to secure a flat tensile member to said hub portion.

3. The hoist assembly of claim 2 wherein said flat tensile member is made of a material selected from the group consisting of steel and polymer fibers including polyethylene, polypropylene, polyolefin, and polyamides.

4. The hoist assembly of claim 3 wherein said flat tensile member comprises a plurality of steel cables encapsulated within a resilient flexible coating.

5. The hoist assembly of claim 3 wherein said flat tensile member comprises a flexible web formed from polymer fibers.

6. The hoist assembly of claim 1 further comprising a head block assembly, said head block assembly being fixed to said frame and aligned with said spool drum, said head block comprising a sheave within a head block housing said sheave configured to receive and redirect a flat tensile member from said spool drum.

7. A hoist assembly for raising and lowering a load comprising:

a frame comprising a plurality of support members;

a gear motor mounted to said frame;

a drive shaft coupled to said gear motor;

at least one spool drum mounted on said drive shaft, said spool drum having a disk portion and a hub portion, said hub portion having an aperture configured such that said hub portion is disposed about said drive shaft;

an end plate fixed to said hub portion opposite to and spaced from said disk portion;

a first spool drum mounted on said drive shaft having a first disk portion and first hub portion;

a second spool drum mounted on said drive shaft having a second disk portion and a second hub portion, wherein said second spool drum is fixed to said first spool drum, and wherein said first hub portion is adjacent to said second disk portion; and an end plate fixed to said second hub portion opposite to and spaced from said second disk portion.

8. The hoist assembly of claim 1 further comprising:

a plurality of said spool drums mounted on said drive shaft adjacent each other, each of said spool drums having a disk portion and a hub portion, wherein a hub portion of each preceding spool drum is adjacent to a hub portion of each subsequent spool drum; and an end plate fixed to an ending spool drum.

9. The hoist assembly of claim 8 further comprising:

a brake configured to prevent rotation of said drive shaft;

an over speed sensor configured to monitor rotation of said drive shaft and activate said brake if said drive shaft rotates greater than a predetermined limit.

10. A hoisting system for raising and lowering a load adapted to be affixed to a structure comprising:

at least one hoist assembly comprising a frame comprising a plurality of support members, a gear motor mounted to said frame, a drive shaft coupled to said gear motor, at least one spool drum mounted on said drive shaft, said spool drum having a disk portion and a hub portion, said hub portion having an aperture configured such that said hub portion is disposed about said drive shaft, a cuneal aperture disposed within said hub portion configured to receive a dead-off, and a slot within said hub portion extending from a tip of said cuneal aperture to the outer edge of said hub portion, wherein said cuneal aperture and said slot cooperate to secure a flat tensile member to said hub portion;

an end plate fixed to said hub portion opposite to and spaced from said disk portion;

at least one loft block assembly mounted to the structure spaced from said hoist assembly; and a connector adapted to secure said flat tensile member to a load.

11. The hoisting system of claim 10 further comprising:

a head block assembly, said head block assembly being fixed to said frame and aligned with said spool drum, said head block comprising a sheave within a head block housing said sheave configured to receive and redirect a flat tensile member from said spool drum.

12. The hoisting system of claim 11 wherein said flat tensile member comprises a plurality of steel cables encapsulated within a resilient flexible coating.

13. The hoisting system of claim 11 wherein said flat tensile member comprises a flexible web formed from polymer fibers.

14. The hoisting system of claim 10 having a plurality of hoist assemblies.

* * * * *